US009963825B2

(12) United States Patent
Fabbricante et al.

(10) Patent No.: US 9,963,825 B2
(45) Date of Patent: May 8, 2018

(54) APPARATUS AND METHOD FOR FORMING A CONTINUOUS WEB OF FIBERS

(71) Applicants: Jack Fabbricante, Medford, NY (US); Thomas Fabbricante, Lynbrook, NY (US)

(72) Inventors: Anthony Fabbricante, Oyster Bay, NY (US); Jack Fabbricante, Medford, NY (US); Thomas Fabbricante, Lynbrook, NY (US)

( * ) Notice: Subject to any disclaimer, the term of this patent is extended or adjusted under 35 U.S.C. 154(b) by 911 days.

(21) Appl. No.: 14/467,730

(22) Filed: Aug. 25, 2014

(65) Prior Publication Data

US 2015/0053359 A1 Feb. 26, 2015

Related U.S. Application Data

(60) Provisional application No. 61/869,407, filed on Aug. 23, 2013.

(51) Int. Cl.
*D21F 1/50* (2006.01)

(52) U.S. Cl.
CPC ..... *D21F 1/50* (2013.01)

(58) Field of Classification Search
USPC ..... 162/203
See application file for complete search history.

(56) References Cited

U.S. PATENT DOCUMENTS

| | | | |
|---|---|---|---|
| 3,707,838 | A | 1/1973 | Dorschner et al. |
| 5,679,379 | A | 10/1997 | Fabbricante et al. |
| 6,471,910 | B1 | 10/2002 | Haggard et al. |
| 6,548,431 | B1 | 4/2003 | Bansal et al. |
| 6,936,554 | B1 | 8/2005 | Singer et al. |
| 7,470,389 | B2 | 12/2008 | Berrigan et al. |
| 7,857,608 | B2 | 12/2010 | Fabbricante et al. |
| 2002/0102897 | A1 | 8/2002 | Berrigan et al. |

FOREIGN PATENT DOCUMENTS

| | | |
|---|---|---|
| EA | 0525263 A1 | 2/1993 |

*Primary Examiner* — Jacob T Minskey
(74) *Attorney, Agent, or Firm* — George W. Moxon, II; Brian P. Harrod

(57) ABSTRACT

A vacuum draw apparatus for preparing a fiber and/or particle web comprising a means for drawing a vacuum on a mass of fibers and/or particles, said vacuum draw means having an opening for applying a vacuum to said mass of fibers and/or particles, an access gate having a patterned opening located between the mass of fibers and/or particles and opening of said vacuum means, and means for moving said access gate, whereby the vacuum draw system will provide an oscillating pull on a mass of fibers and/or particles to work said mass to redistribute and/or further consolidate the fibers and/or particles.

14 Claims, 6 Drawing Sheets

APPARATUS AND METHOD FOR FORMING A CONTINUOUS WEB OF FIBERS

CROSS REFERENCE TO RELATED APPLICATIONS

This application claims the benefit of U.S. Provisional application No. 61/869,407 filed on Aug. 23, 2013, which is entitled "Apparatus and Method for Forming a Continuous Web of Fibers" and is incorporated herein by reference.

BACKGROUND OF THE INVENTION

The present application relates to a vacuum table for consolidating fibers such as are produced or formed as a continuous, nonwoven fiber web or mass, to achieve an improved density of the web or mass and/or distribution of the particles and/or fibers. In particular, the present invention utilizes a vacuum table having a moveable screen that has a patterned opening and is located between the fibers and/or particles and the vacuum source, so that the vacuum draw system will provide an oscillating pull on a fiber web and/or particle mass when it comes from the former to work the fiber mass and/or particles to redistribute the fibers and/or particles, fluids, or gasses, to adjust for specified densities and distributions of the nonwoven fiber web and/or particles.

Fibrous and/or particle webs are conventionally prepared by extruding or spinning a liquid fiber-forming or particle-forming material through a die to form a stream of filaments or particles, processing the filaments and/or particles during their travel from the die by quenching and/or drawing them, and then collecting the stream of filaments and/or particles on a porous collector. For example, a non-woven web of filaments deposited on a collector as a mass of fibers might be in the form of a handleable web or may be processed to form such a web. Often, a vacuum is used to help form the fibrous nonwoven web or mass and/or consolidate the mass. A vacuum will be used to densify the mass and distribute of the fibrous nonwoven web or mass.

Typically, the collected mass or web is of a density and distribution which is dependent on the apparatus set-up. It is not possible to make any or many adjustments to the web or mass. The pattern for the density and distribution of the fibrous nonwoven web or mass of a particular apparatus is normally set upon the construction of the machine and the setting of the vacuum. The density and distribution of the nonwoven fiber web cannot be changed unless the set-up of the machine is altered.

SUMMARY OF THE INVENTION

The current invention is an apparatus and method for preparing fibrous webs with varied and/or improved density and/or distribution via a continuous screen or collection belt using a vacuum table that employs a moveable screen or access gate. The densities are controlled by a combination of the feed means for forming fibers, and the oscillation or rotational speed of the access gate. This access gate utilizes a moveable screen having a patterned opening, and is positioned between the web of fibers and/or particles, fluids, or gasses which are included, on the continuous belt and the vacuum source.

As a moving screen carries the fiber and/or particle web over the vacuum table, the vacuum draw system will provide an oscillating pull force to provide a varying or oscillating draw force on the fiber and/or particle mass and work it to redistribute the fibers and/or particles, fluids, or gasses. This will allow the web to be further consolidated, to achieve certain specific densities and/or distributions, or to achieve different properties.

BRIEF DESCRIPTION OF THE INVENTION

The foregoing and other features and advantages of the present invention will become apparent to those skilled in the art to which the present invention relates upon reading the following description with reference to the accompanying drawings, in which.

DETAILED DESCRIPTION OF THE INVENTION

The current invention is an apparatus and method for preparing fibrous nonwoven webs that can have their density and/or distribution varied and/or improved on a continuous screen or collection belt by using a vacuum table that employs a moveable screen, hereinafter referred to as an "access gate." The access gate moves by oscillating or rotating. It can be used to consolidate particles, fluids, gasses, and/or fibers. The densities are controlled by a combination of one or more of the extruders, which feeds the metering pump, which feeds the means for forming fibers, such as a spinneret, and the oscillation or rotational speed of the access gate. The gate can rotate at speeds from 1 to 5000 revolutions per minute in the case of a rotating gate. The gate can oscillate at a frequency of 1 to 5000 oscillations or movements per minute in the case of an oscillating gate. This access gate utilizes a moveable screen having a patterned opening. The openings are either cut into a continuous surface, and thus created by removing material, or created when the access gate is formed. Further, the access gate is positioned between the web of fibers and/or particles on the continuous belt and the vacuum source.

As a moving screen carries the fiber and/or particle web from a web former over the vacuum table, the vacuum draw system, in combination with the vacuum gate, will provide an oscillating pull force to provide a varying or oscillating draw force on the fiber and/or particle mass and work the fiber and/or particle mass to redistribute the fibers and/or particles. This will allow the web to be further consolidated, to achieve certain specific densities and/or distributions, or to achieve different properties.

For the purpose of this invention, the term "particle" is intended to include solid particles, such as might be added to a fibrous web, such as for example, inorganic particles that might included in a fibrous web to improve its fire resistance, as well as fluid or liquid particle, or gaseous particles, which might be added to a fibrous substrate to effectively coat the fibers, in whole or in part, of the substrate and produce a fibrous substrate having certain characteristics, such as improved water resistance or repellency, stain resistance or repellency, or adhesive characteristics, such as when a liquid, adhesive binder is added to a fibrous substrate. Further, the fibers can be continuous nonwoven fibers, or could be staple fibers, cut fibers, chopped fibers, or the like. Still further, the "particles" could include fibrous particles, as desired.

Figure 1:
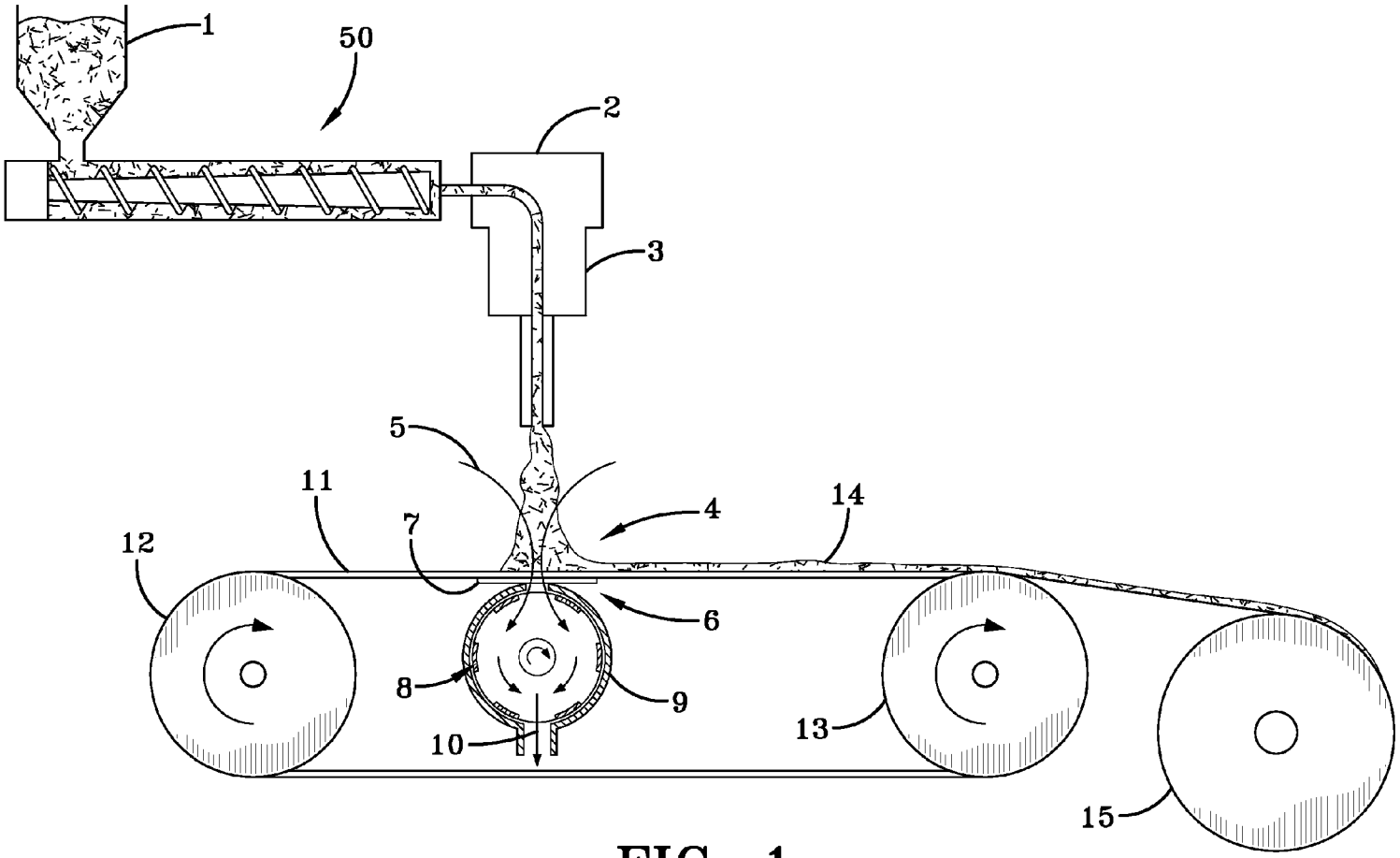
FIG. 1 is a schematic drawing of an apparatus showing the overview of the process and apparatus which employs a vacuum table in accordance with the present invention.

A typical fiber and/or particle web forming apparatus includes a means for forming a fiber and/or particle web, a means for collecting the web and moving the web to a collection point. The nonwoven fiber or other solid may be consolidated by using a vacuum table, before the web is collected via a roller or other system as shown in FIG. 1, which shows an overview of the fiber and/or particle making apparatus. An extruder 50 may be used to create a fiber mass or particle mass 4, which is deposited on a continuous belt and forms into a web. The web is consolidated by a vacuum former.

In making fiber or particle webs, a fiber-forming material or other solid is brought to an extrusion head or die. In this apparatus shown, a fiber-forming or particle-forming material is introduced into a hopper 1, the material is melted in an extruder, and then the molten material is pumped into the extrusion head through a metering pump 2. Typically, solid polymeric material in pellet or other particulate form is melted to a liquid, pumpable state, and extruded to form fiber or other shapes. Alternatively, the extrusion head 3 may be in the form of a conventional spinneret, generally including multiple orifices arranged in a regular pattern, e.g., straightline rows. Filaments of fiber-forming or particle-forming material 4 are extruded from the extrusion head and conveyed to a processing chamber or attenuator 6 with help from the air flow 5. The distance the extruded fibers and/or particles travel before reaching the attenuator can vary, as can the conditions to which they are exposed. The air flow 5 helps to move the fibers and/or particles to the processing chamber, but can also have additional advantages.

The materials employed to form the particles and/or fibers are not critical and can be any of the materials normally employed for this purpose. The mass can be formed from the same fibers or can be mixtures of fibers and/or particles. These can be materials of the same or different compositions, and thus could be the same polymeric composition or could be different polymer compositions. Further, the particles or fibers could be of the same or different sizes Typically, quenching streams of air or other gas are presented to the extruded filaments by conventional methods and apparatus to reduce the temperature of the extruded filaments. The stream of filaments or other solids can pass through a processing chamber. As illustrated in FIG. 1, the stream exits onto a collector where the filaments, or finished fibers or finished particles, are collected as a product that may or may not be coherent and take the form of a handleable web. The fibers and/or particles or filament stream preferably has spread when it exits from the attenuator and travels over the distance to the processing chamber 6. The processing chamber contains a fixed screen 7 along with a moving continuous screen 11. The continuous moving screen is put into motion by the drive roll 13 and the roller 12. The collector fixed screen 7 is generally porous. An access gate 8 and housing 9 along with a vacuum system (illustrated in FIG. 2) are located below the processing chamber to assist in a specified deposition of fibers and/or particles onto the processing chamber. The collected mass product 14 may be conveyed to other apparatuses such as calendars, embossing stations, laminators, cutters and the like; or it may be passed through drive rolls 13 and wound into a take-up roll 15. After passing through the processing chamber, but prior to collection, extruded filaments, fibers, particles, or solids may be subjected to a number of additional processing steps not illustrated in FIG. 1, e.g., further drawing, spraying, etc.

Figure 2:
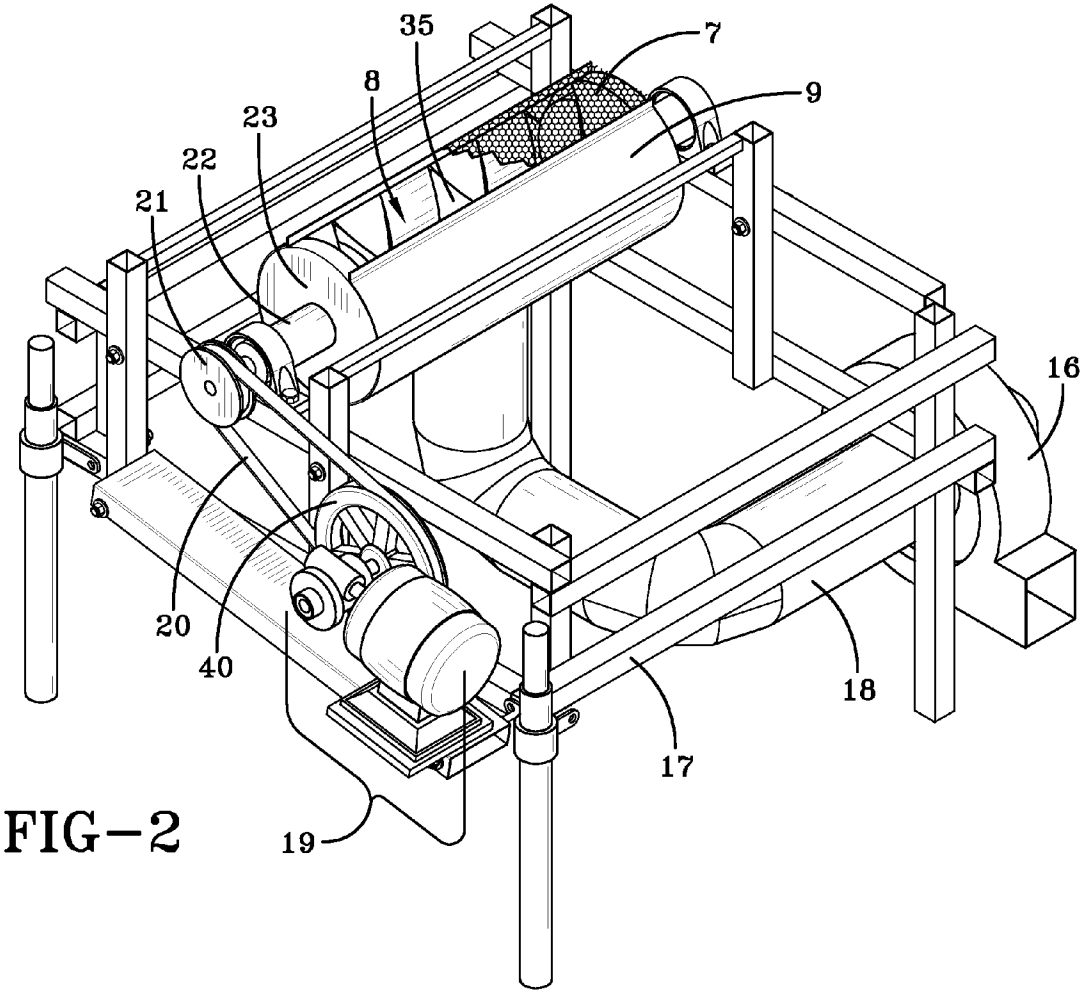
FIG. 2 is a perspective view of a vacuum system apparatus in accordance with the present invention.

The present vacuum table or vacuum draw system, as shown in FIG. 2, is comprised of a vacuum draw housing having an opening for applying a vacuum to a moving web of non-woven fibers, a means for drawing a vacuum on said housing, an access gate having a patterned opening located between the fibers and the vacuum means, and means for moving the screen, whereby the vacuum draw system will provide a rotating or oscillating pull on a fiber web designed to provide a draw on the fiber mass as it comes from a fiber former and work the fiber mass to redistribute the fibers. Also, a method of making fibers or particles using a vacuum draw system with a screen or access gate having a patterned opening designed to provide a draw on the fiber mass as it comes from the fiber former and work the fiber mass to redistribute the fibers in some way, a means for moving the access gate, and a vacuum force.

Figure 9:
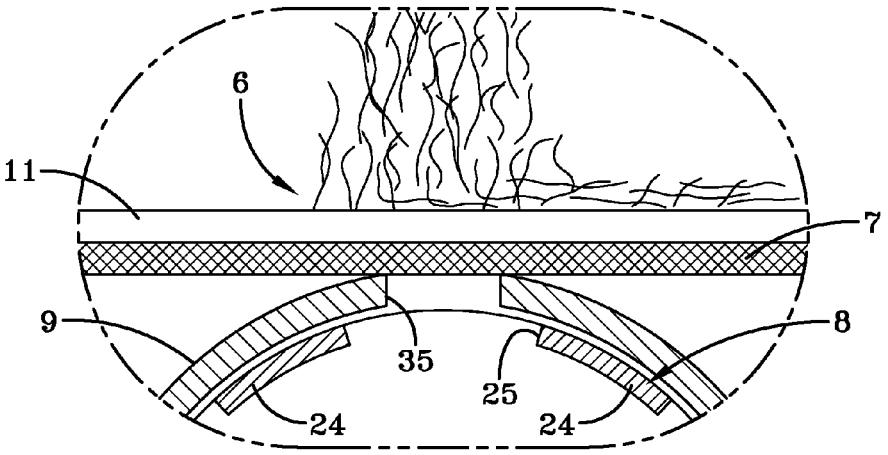
FIG. 9 is an enlarged view of a portion of the access gate in FIG. 3.

As seen in FIG. 2, the opening 35 (seen best in FIGS. 3 and 9) leads to an access gate 8 which controls the vacuum flow and which is placed within an enclosed chamber or housing 9. The access gate can be different shapes, including spiral, flat, cylindrical, round, rectangular, hexagonal, octagonal, and like shapes. The shape can also be tapered. The shape is not critical. A fixed screen 7, which is shown cut away, extends over the opening 35 to the access gate and support the continuous screen 11 which passes over the opening 35 and which carries the fiber and/or particle mat which is formed and collected on it. The vacuum is drawn via a vacuum blower 16. Fixed screen 6 can be a mesh screen having openings of various geometrical shapes, such as round, triangular, square, rectangular, and the like.

The vacuum table is supported by a frame 17, the design of which is not critical—it only acts to support the blowers, motors, vacuum systems, access gate, and other parts—other supporting systems can be employed. The vacuum table also employs a vacuum conduit 18, which connects the housing 9 with the vacuum blower 16, which can be a variable speed blower to vary the vacuum draw. The access gate 8 in this embodiment is a cylindrical shape having end caps 23 to which are attached axles 22. The access gate 8 is rotated via the axles 22 inside the housing 9 via a belt 20 and pulley system. Pulley 21, which is connected to axle 22, and pulley 40, which is connected to motor 19, is driven by motor 19. The motor 19, pulleys 21 and 40, and belt 20 drive rotary gate 8 are connected to and supported by the frame. The motor 19 can be a variable speed motor to adjust the rotation of the access gate 8 and thus the oscillation pull on the fiber and/or particle web.

Figure 3:
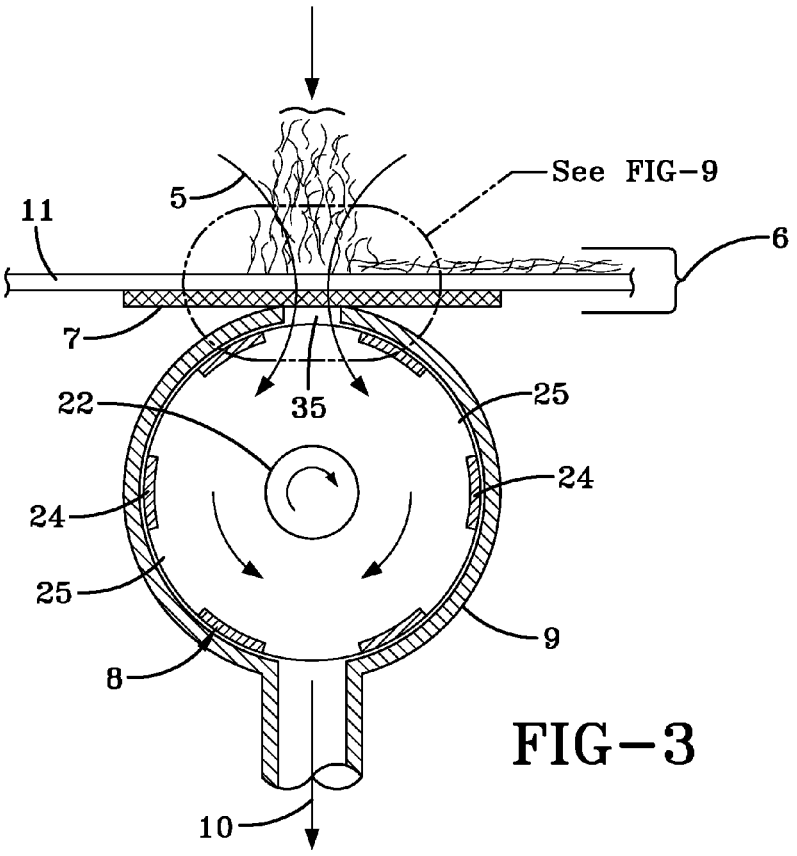
FIG. 3 is a side view of an access gate and vacuum system in accordance with the present invention.
Figure 4:
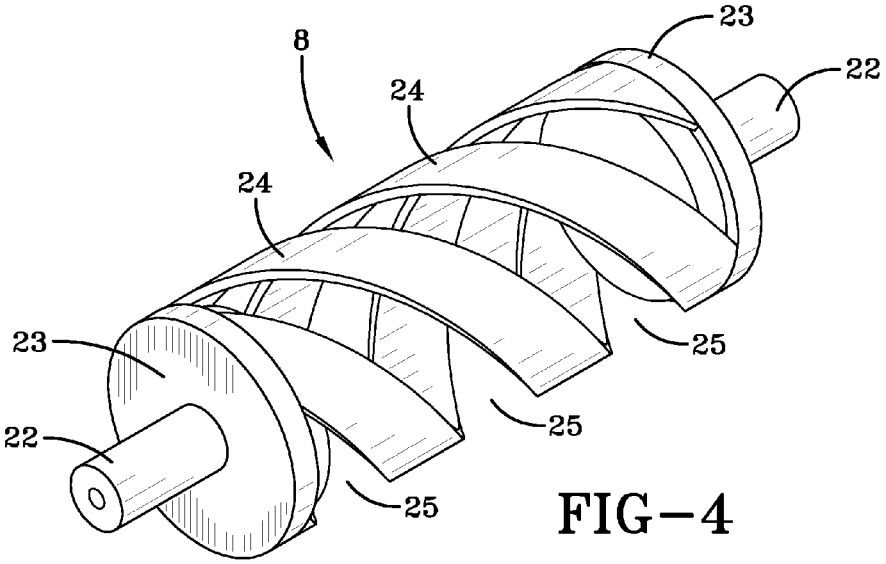
FIG. 4 is a perspective view of one embodiment of an access gate in accordance with the present invention.

As seen in FIG. 3, the air flow 5 moves through the processing chamber 6, the continuous screen 11 and fixed screen 7, then through the access gate 8 and ultimately to the blower 16. The figure demonstrates how the vacuum system of the apparatus helps to influence the fiber web along the screen to alter density and distribution. The access gate 8 will produce a lateral drawing force on the fiber and/or particle web. As the access gate shown in FIG. 4 rotates, the space or opening 25 will be moving and the vacuum opening 25 will be shifting laterally. Thus, a continuous shifting pull from the vacuum will be asserted. If the opening 25 were in a zigzag or chevron shape (see FIG. 4A), the vacuum flow would oscillate in a back and forth fashion. The access gate can be manufactured to create the openings, by forming a spiral access gate device, as shown in FIG. 4, or the opening can be created by removing material from a continuous surface to create the shape of the opening. The shape of the openings can be spiral, square, rectangular, circular, diamond, or triangular, or a combination thereof. Although this figure shows a cylindrical shape, it can also be flat, as shown in FIGS. 5-8. If it is cylindrical, it can be made out of a spiral ribbon of metal or cutout from a cylinder of metal. It could also be made out of alternative materials besides metal. The extent of spreading of the stream of extruded filaments or fibers can be controlled in this device by adjustments. This device shown offers a desired continuity of operation even when running at high speeds with narrow-gap processing chambers and fiber-forming material in a softened condition when it enters the processing chamber.

Figure 4A:
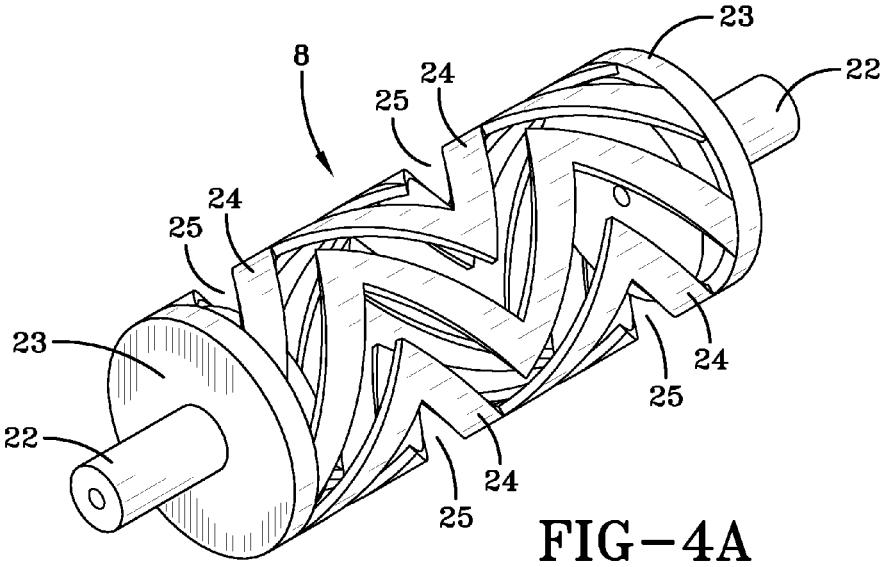
FIG. 4A is a perspective view of another embodiment of an access gate in accordance with the present invention.

When the gate is a spiral shape, as shown in FIG. 4, the rotation of the gate 8 will mean that the opening space 25 will continually shift in one direction. For example, if gate 8 is rotated in a counterclockwise direction the opening 25 will shift from right to left. The reverse will be true if gate 8 were rotated clockwise. So, opening 25 in combination with the opening 42 in housing 9 will provide a pull in one direction. The resulting pull provides some oscillation motion, but it will be a one-way pull, for the most part. This action may be sufficient to provide the necessary compaction or adjustment of the web of fibers and/or particles. A greater oscillation motion can be achieved by having opening 25 be in the form of a zigzag pattern as shown in FIG. 4A. The opening will effectively move in one direction relative to opening 42 for part of the rotation and then go the other direction for the rest of the rotation. For the purpose of this application, we intend the term "oscillating" to include the substantially one-way pull as well as the two way pull.

Figure 5:
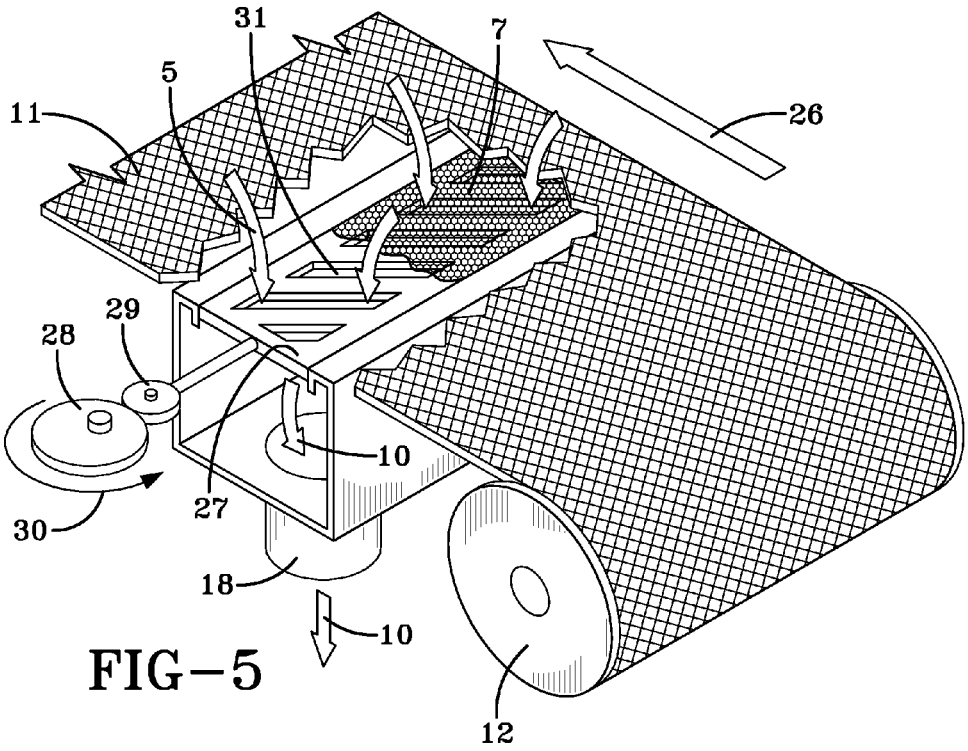
FIG. 5 is a side perspective view, partially broken away, of a vacuum system in accordance with the present invention.
Figure 6:
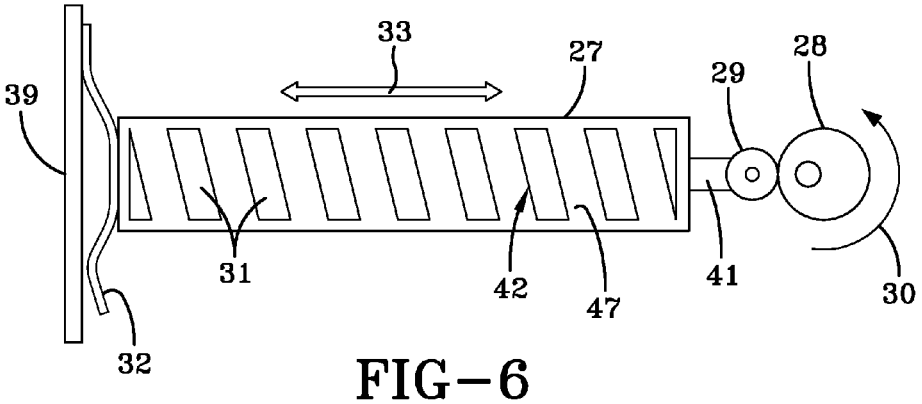
FIG. 6 is a top view of an access gate employed with an off-set cam and spring mechanism.
Figure 7:
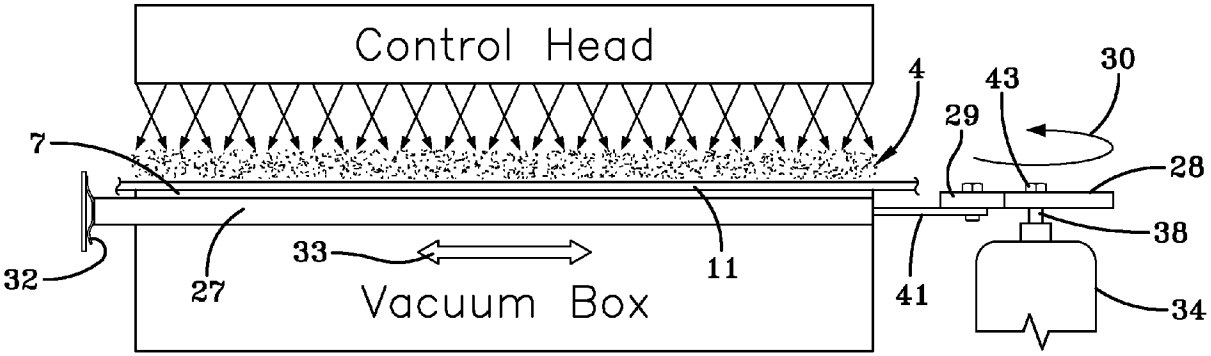
FIG. 7 is a side view of the access gate shown in FIG. 6 employed with a fiber forming apparatus and a vacuum system in accordance with the present invention.

As seen in FIGS. 5 and 7, the access gate 27 is flat and the gate is oscillated via an off-set cam 28 and follower roller 29. The air flow 5 will pass through the mass 4, the continuous screen 11, the fixed screen 7, and the access gate 27 as it enters the vacuum system. A motor will rotate the eccentric or offset cam 28 and apply a force via follower roller 29 to the access gate 27. The follower roller 29 is attached to a fixed connector arm 41 (see also FIG. 6) and is forced to move laterally in a plane. The force of the cam 28 is opposed by a spring 32 supported by a surface 39 (see FIG. 6) and as the cam rotates the force of the spring will move the access gate 27 in the reverse direction from the cam. Thus, the flat access gate will move back and forth and that action will produce an oscillating motion on the mass 4. This can also be seen in FIG. 7 where fibers and/or particles 4 are laid down under a control head on the continuous screen 11 and fixed screen 7 to form a fibrous web or solid mass at an improved density or distribution. An alternative to the cam and spring shown would be to use an eccentric cam with a pneumatic actuator or a servo motor powered linear actuator (not shown).

The access gate shown in FIG. 6 is a flat access gate 27 and has spaces 31 within it. The shape of these spaces can be varied. This oscillating device alters the density and distribution of the fibers and/or particles. The shape of the openings or spaces 31 is not critical. Like the rotary gate 8 (see FIGS. 4 and 4A) the spaces can be manufactured into the gate or can be formed by removing material from the gate. As shown in FIG. 6, the spaces are parallelograms 42 cut out of the access gate body 47. The openings 31 could be other shapes, including round, square, ovals, triangles, and the like geometric shapes. They could be, for example, round shapes aligned to form slanting lines similar to those shown in FIG. 6.

The oscillating movement 33 of the access gate 27 is shown in the FIGS. 6 and 7. The offset cam 28 rotates 30, providing a means for the oscillation of the access gate, with the aid of a spring 32.

Figure 8:
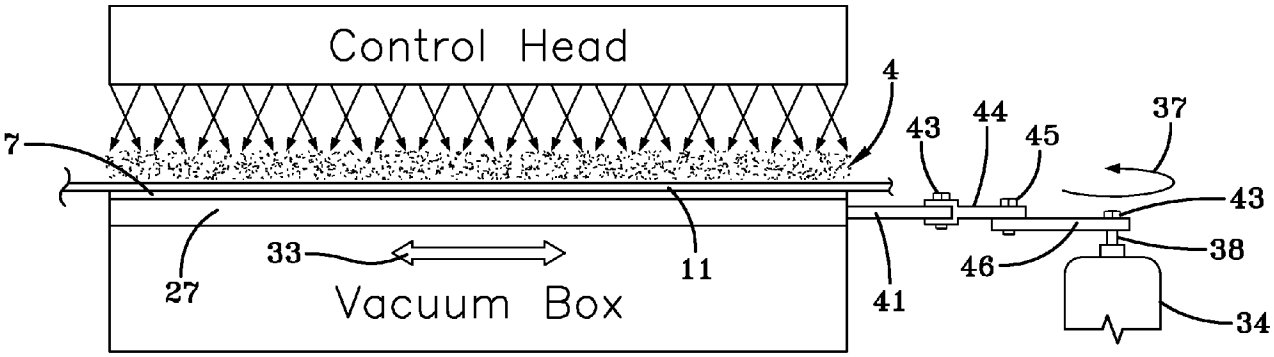
FIG. 8 is a side view similar to FIG. 7, but of an eccentric pulley embodiment of the access gate.

Another embodiment is shown in FIG. 8 where the oscillating gate of the vacuum draw apparatus is oscillated via an off center pulley arrangement. The fibers and/or particles 4 are laid down under the control head on the continuous screen 11 forming a fibrous web and/or solid mass. The oscillation of the access gate occurs through the movement of the off-center pulley 46. In this embodiment, the oscillating motion is achieved via a motor 34 which rotates a rotating arm 46 which is affixed to a shaft 38. As the rotating arm 46 moves about the shaft 38, it will pull and then push access gate 27 in a horizontal plane via fixed arm 41 and link arm 44. The push/pull movement will move the access gate 27 back and forth to create the oscillation motion for the vacuum draw due to the movement of the openings or spaces 31 (best seen in FIG. 6).

Although the invention has been described in detail with reference to particular examples and embodiments, the examples and embodiments contained herein are merely illustrative and are not an exhaustive list. Variations and modifications of the present invention will readily occur to those skilled in the art. The present invention includes all such modifications and equivalents. The claims alone are intended to set forth the limits of the present invention.

What is claimed is:

1. A vacuum draw apparatus for preparing a fiber and/or particle web comprising a) a means for drawing a vacuum on a mass of fibers and/or particles, b) said vacuum draw means having an opening for applying a vacuum to said mass of fibers and/or particles, c) an access gate having a patterned opening located between the mass of fibers and/or particles and said opening of said vacuum means, and d) a means for moving said access gate, whereby the vacuum draw system creates an oscillating pull on said mass of fibers and/or particles to work said mass to redistribute and/or further consolidate the fibers and/or particles.

2. The apparatus of claim 1 wherein the access gate rotates.

3. The apparatus of claim 1 wherein the access gate rotates and has rotation speeds from 1 to 5000 revolutions per minute.

4. The apparatus of claim 1 wherein the patterned openings of the access gate are selected from the group consisting of squares, rectangles, trapezoids, circles, triangles, diamond shapes, and combination of these patterns.

5. The apparatus of claim 1 wherein the vacuum system housing is rectangular.

6. The apparatus of claim 1 wherein the vacuum system housing is cylindrical and said access gate rotates inside said cylindrical housing.

7. The apparatus of claim 1 further incorporating a fixed screen between the fibers and/or particles and said vacuum opening.

8. A process for consolidating and/or redistributing the fibers and/or particles in a mass of fibers and/or particles comprising the steps of:

producing a mass of fibers and/or particles;

collecting said mass of fibers and/or particles;

passing said mass of fibers and/or particles over a vacuum draw system;

said vacuum draw system comprising:

a) means for drawing a vacuum on a mass of fibers and/or particles, b) said vacuum draw means having an opening for applying a vacuum to said mass of fibers and/or particles, c) an access gate having a patterned opening located between the mass of fibers and/or particles and said opening for said vacuum means, and d) means for moving the access gate, whereby the vacuum draw system provides an oscillating pull on a mass of fibers and/or particles to work said mass to redistribute and/or further consolidate the fibers and/or particles whereby said vacuum draw system provides an oscillating pattern of vacuum draw on the fiber and/or particle mass as it passes over said vacuum draw system to work the mass to redistribute the fibers or particles, redistributing and/or consolidating said mass of fibers and/or particles, and collecting said mass of fibers and/or particles.

9. The process of claim 8 wherein the access gate rotates.

10. The process of claim 8 wherein the access gate rotates and has rotation speeds from 1 to 5000 revolutions per minute.

11. The process of claim 8 wherein the patterned opening of the access gate is spiral, square, rectangular, circular, or triangular, diamond shape, other geometric pattern, or a combination of patterns.

12. The process of claim 8 wherein the vacuum system housing is rectangular.

13. The process of claim 8 wherein the vacuum system housing is cylindrical and has a moving screen that rotates inside said cylindrical housing.

14. The process of claim 8 wherein the fibers and/or particles are replaced with another solid such as a powder or other fiber and/or particle and the laydown of the solids is to a substrate or other carrier.

* * * * *